US006560433B1

(12) United States Patent
Yamakama

(10) Patent No.: US 6,560,433 B1
(45) Date of Patent: May 6, 2003

(54) IMAGE FORMING APPARATUS HAVING CONTROLLED VELOCITY IMAGE CARRIER AND RECORDING MEDIUM

(75) Inventor: Takeshi Yamakama, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/708,021

(22) Filed: Nov. 8, 2000

(30) Foreign Application Priority Data

Nov. 8, 1999 (JP) ..... 11-317436

(51) Int. Cl.[7] ..... G03G 15/16
(52) U.S. Cl. ..... 399/297; 399/75; 399/396
(58) Field of Search ..... 399/396, 75, 167, 399/302, 308, 312, 297; 347/234, 248, 249

(56) References Cited

FOREIGN PATENT DOCUMENTS

| | | | |
|---|---|---|---|
| JP | 5-35044 | * | 2/1993 |
| JP | 6-149077 | | 5/1994 |
| JP | 8-146789 | | 6/1996 |
| JP | 8-160782 | | 6/1996 |
| JP | 10-161441 | * | 6/1998 |
| JP | 10-308858 | | 11/1998 |
| JP | 11-65396 | | 3/1999 |
| JP | 2000-155516 | * | 6/2000 |

* cited by examiner

*Primary Examiner*—Joan Pendegrass
(74) *Attorney, Agent, or Firm*—Oblon, Spivak, McClelland, Maier & Neustadt, P.C.

(57) ABSTRACT

An image forming apparatus of the present invention includes an image carrier for carrying a toner image thereon while being driven to rotate. A conveyor conveys a recording medium, to which the toner image is to be transferred from the image carrier, to an image transfer position. An image carrier controller controls the linear velocity of the image carrier in rotation. A conveyance controller controls the linear velocity of the recording medium being conveyed by the conveyor. A main controller controls the image carrier controller and conveyance controller such that the mean linear velocity of the image carrier and that of the recording medium are different from each other.

4 Claims, 5 Drawing Sheets

IMAGE FORMING APPARATUS HAVING CONTROLLED VELOCITY IMAGE CARRIER AND RECORDING MEDIUM

BACKGROUND OF THE INVENTION

The present invention relates to an image forming apparatus of the type exposing the surface of an image carrier with a laser beam in accordance with image data to thereby form a latent image thereon, developing the latent image to thereby produce a corresponding toner image, transferring the toner image to a recording medium, and then fixing the toner image on the recording medium. More specifically, the present invention is concerned with an image forming apparatus capable of stabilizing the linear velocity of the image carrier susceptible to the linear velocity of the recording medium during the transfer of the toner image.

In an image forming apparatus of the type described, when a toner image is transferred from an image carrier, e.g., photoconductive element to a paper sheet, the rotation of the image carrier and the conveyance of the paper sheet are control led such that the linear velocity of the image carrier coincides with the linear velocity of the paper sheet, as measured at an image transfer position. Any difference between the two linear velocities causes the image carrier to rub the toner image carried on the paper sheet at the time of image transfer, thereby blurring the toner image or varying the length thereof in the subscanning direction. So long as the linear velocities are coincident, the toner image can be transferred from the image carrier to the paper sheet without the magnification thereof being varied. However, even if the mean linear velocity of the image carrier and that of the paper sheet are coincident, the linear velocities each are apt to fluctuate. Particularly, sharp variation in linear velocity gives rise to problems that will be described specifically with reference to the accompanying drawings.

Technologies relating to the present invention are disclosed in, e.g., Japanese Patent Laid-Open Publication Nos. 6-149077, 8-146789, 8-160782, 10-308858, and 11-65396.

SUMMARY OF THE INVENTION

It is therefore an object of the present invention to provide an image forming apparatus capable of preventing the speed of an image carrier from sharply varying.

An image forming apparatus of the present invention includes an image carrier for carrying a toner image thereon while being driven to rotate. A conveyor conveys a recording medium, to which the toner image is to be transferred from the image carrier, to an image transfer position. An image carrier controller controls the linear velocity of the image carrier in rotation. A conveyance controller controls the linear velocity of the recording medium being conveyed by the conveyor. A main controller controls the image carrier controller and conveyance controller such that the mean linear velocity of the image carrier and that of the recording medium are different from each other.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
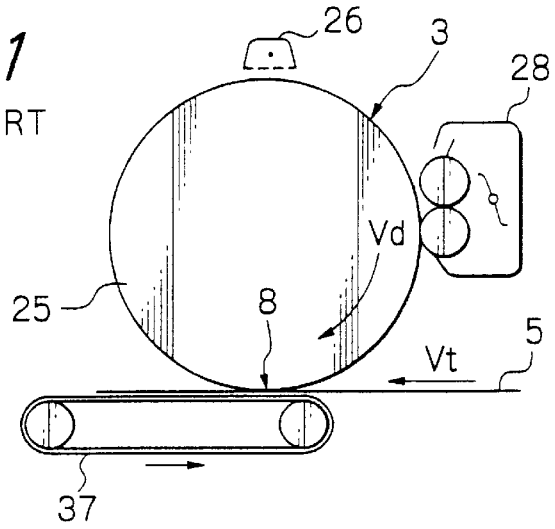
Fig. 1 PRIOR ART
FIG. 1 is a fragmentary view showing a conventional image forming apparatus.

To better understand the present invention, brief reference will be made to a conventional image forming apparatus, shown in FIG. 1 in a fragmentary view. As shown, the image forming apparatus includes an image carrier 25 implemented as a photoconductive drum by way of example. The image carrier 25 is rotatable in a direction indicated by an arrow in FIG. 1. A charger 26, an exposing section, not shown, a developing unit 28 and an image transfer position 8 are arranged around the image carrier 25.

The charger 26 uniformly charges the surface of the image carrier 25. The exposing section scans the charged surface of the image carrier 25 with a laser beam 3 issuing from a laser, not shown, and modulated in accordance with image data. As a result, a latent image is electrostatically formed on the image carrier 25. The developing unit 28 develops the latent image with toner to thereby form a corresponding toner image. The toner image is transferred from the image carrier 25 to a paper sheet or similar recording medium 5 at the image transfer position 8. A conveyor 37 conveys the paper sheet carrying the toner image thereon to a fixing unit, not shown. The fixing unit fixes the toner image on the paper sheet 5. Finally, the paper sheet or printing 5 is driven out of the image forming apparatus.

Generally, a controller, not shown, controls the rotation of the image carrier 25 and the conveyance of the paper sheet 5 such that the linear velocity or surface speed Vd of the image carrier 25 coincides with the linear velocity or surface speed Vt of the paper sheet 5, as measured at the image transfer position 8. Any difference between the linear velocities Vd and Vt causes the image carrier 25 to rub the toner image carried on the paper sheet 5 at the time of image transfer, thereby blurring the toner image or varying the length thereof in the subscanning direction. Consequently, even if the toner image formed on the image carrier 25 has an accurate dimension in the above direction, it is varied in magnification on the paper sheet 5. So long as the linear velocities Vd and Vt are coincident, the toner image can be transferred from the image carrier 25 to the paper sheet 5 without the magnification thereof being varied.

However, even if the mean linear velocity of the image carrier 25 and that of the paper sheet 5 are coincident, the linear velocities Vd and Vt each are apt to fluctuate due to mutual interference. Specifically, the linear velocities Vd and Vt each vary in a particular pattern. This, coupled with friction acting at the image transfer position 8, brings about the mutual interference of the linear velocities Vd and Vt.

Figure 2:
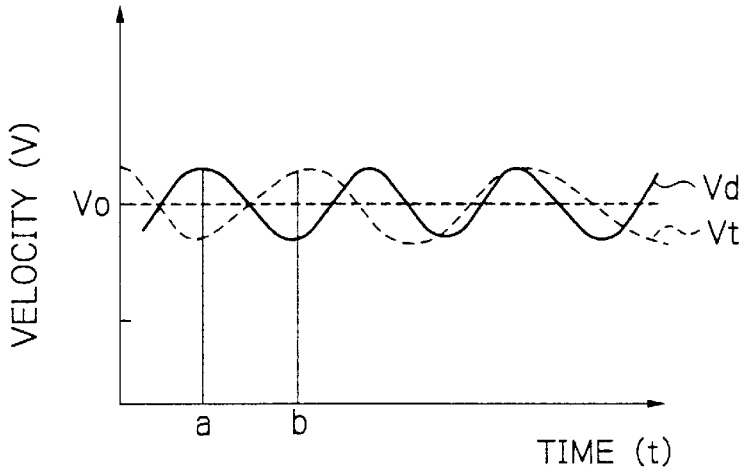
Fig. 2 PRIOR ART
FIG. 2 is a graph showing how the linear velocity of an image carrier included in the apparatus of FIG. 1 and that of a paper sheet vary when mean linear velocities are the same as each other.

FIG. 2 shows how the linear velocities Vd and Vt vary when their mean values are coincident. As shown, the linear velocity Vt of the paper sheet 5 being conveyed by the conveyor 37 is sometimes lower than the linear velocity Vd of the image carrier 25 (time a) and sometimes higher than the same (time b). This is ascribable to a motor and drive transmitting portions not shown.

In the condition shown in FIG. 2, friction acting between the image carrier 25 and the paper sheet 5 exerts a force that draws the image carrier 25 in the direction of rotation (e.g. time b) and a force that returns it in the opposite direction (e.g. time a). Usually, backlash occurs in a drive line assigned to the image carrier 25 due to the above friction. On the other hand, the controller, including a feedback system, increases or decreases the linear velocity (rotation speed) of the image carrier 25 complimentarily to the backlash ascribable to the paper sheet 5, thereby canceling the backlash. More specifically, when the image carrier 25 is in contact with the paper sheet 5 at the image transfer position 8, the linear velocity Vd1 (see FIG. 3) of the image carrier 25 varies in accordance with the linear velocity Vt of the paper sheet at the initial part of a difference in linear velocity occurring between the image carrier 25 and the paper sheet 5. Subsequently, after the controller has cancel led the backlash with the feedback system, the image carrier restores its original linear velocity Vd.

Figure 3:
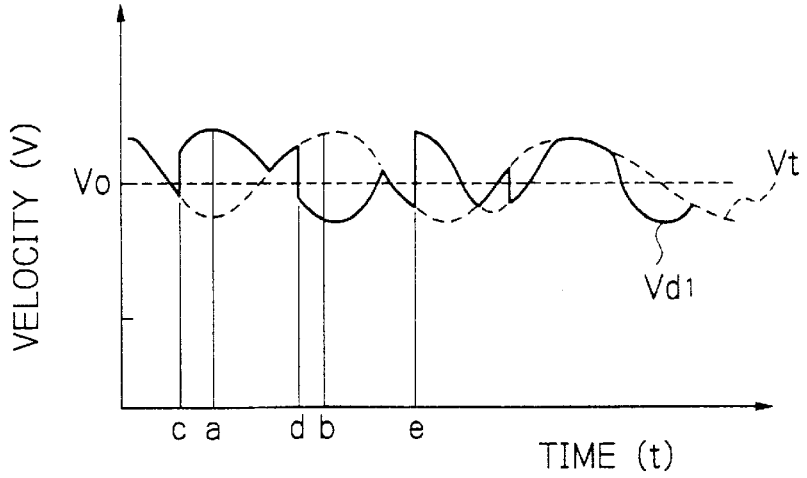
Fig. 3 PRIOR ART
FIG. 3 is a graph showing how the linear velocity of the image carrier vary due to backlash ascribable to the linear velocity of the paper sheet.

FIG. 3 shows how the linear velocity Vd1 of the image carrier 25 varies due to the backlash a scribable to the friction. Assume the initial part of a difference in linear velocity occurring between the image carrier 25 and the paper sheet 5, e.g., an interval between the time when the linear velocity Vd1 (solid curve) crosses a mean velocity Vo (dotted line) for the first time and a time c. Then, during this interval, the linear velocity Vd1 is coincident with the linear velocity Vt of the paper sheet 5. However, when the controller cancels the backlash at the time c, the image carrier 25 tends to rotate at its original linear velocity Vd, resulting in a sharp change in velocity at the time c. Such a sharp change occurs at times d and e also. At the times c, d and e, the sharp change in velocity (unstable rotation) adversely effects even the charging, exposing and developing operations.

For example, as for the exposing operation using the laser beam 3, the interval between the consecutive exposure in the subscanning direction varies due to the unstable linear velocity Vd of the image carrier 25, degrading the quality of the latent image to be formed on the image carrier 25. Also, the unstable linear velocity Vd prevents the developing unit 28 from uniformly developing the latent image and thereby brings about background contamination in the main scanning direction or makes image density short.

Figure 4:
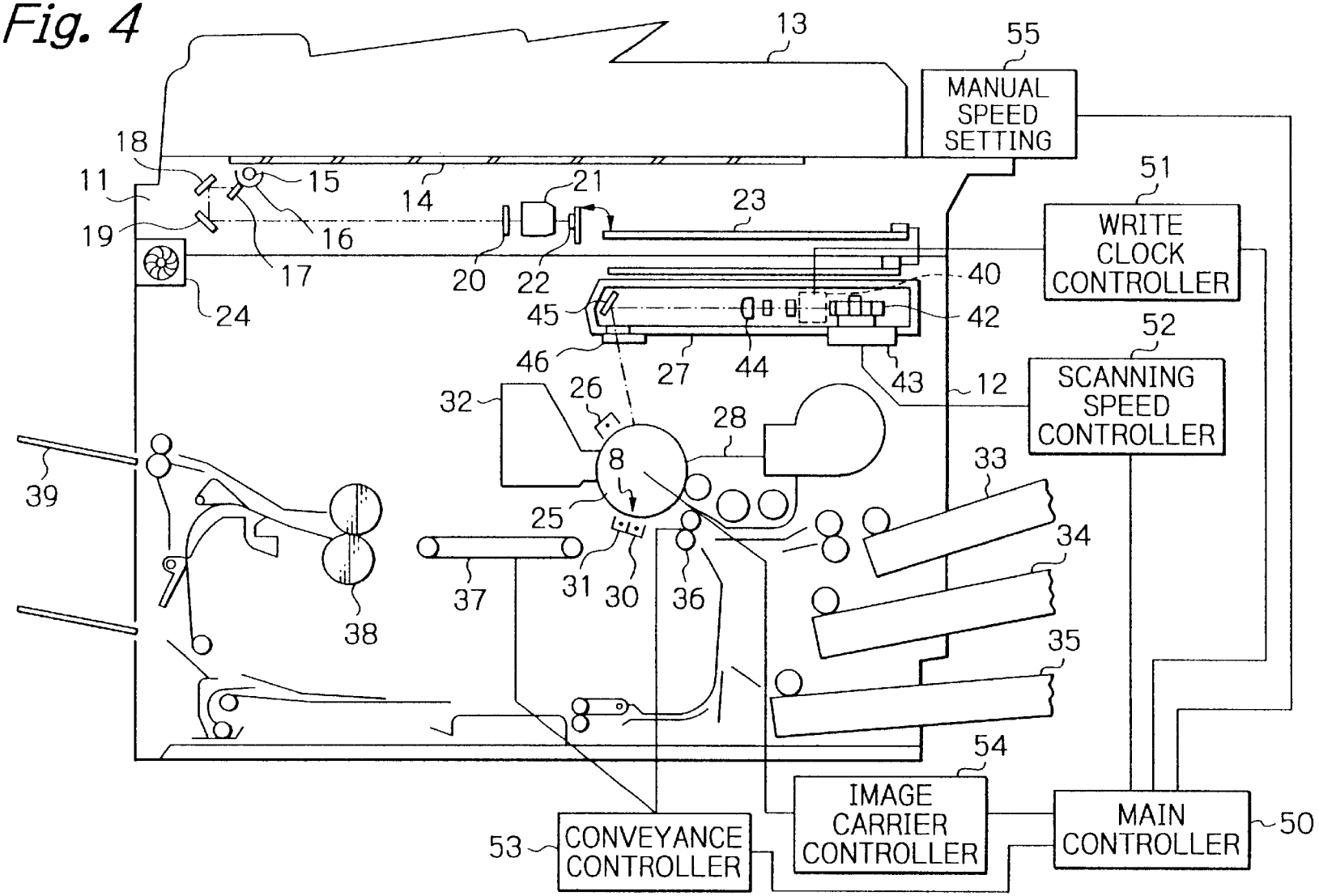
FIG. 4 is a view showing an image forming apparatus embodying the present invention.
Figure 5:
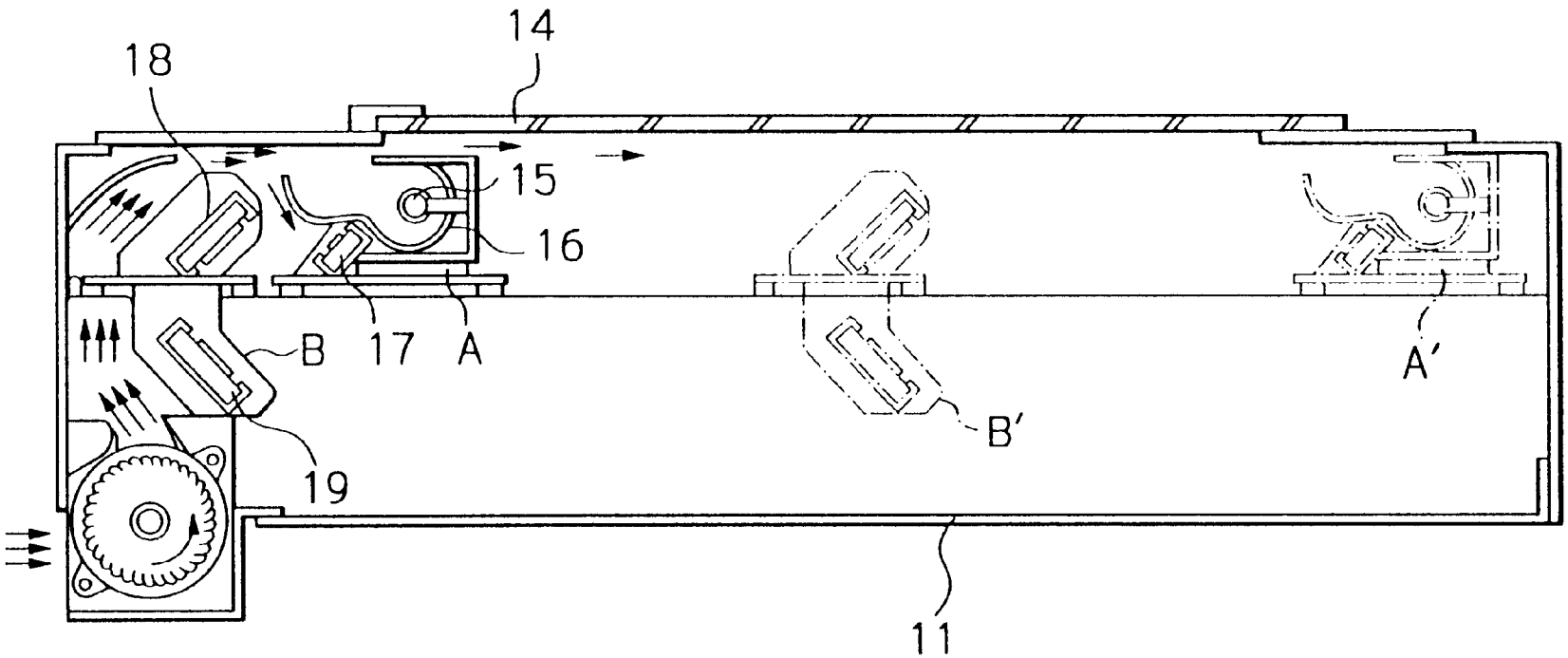
FIG. 5 is a view showing a laser beam scanning unit included in the illustrative embodiment specifically.
Figure 6:
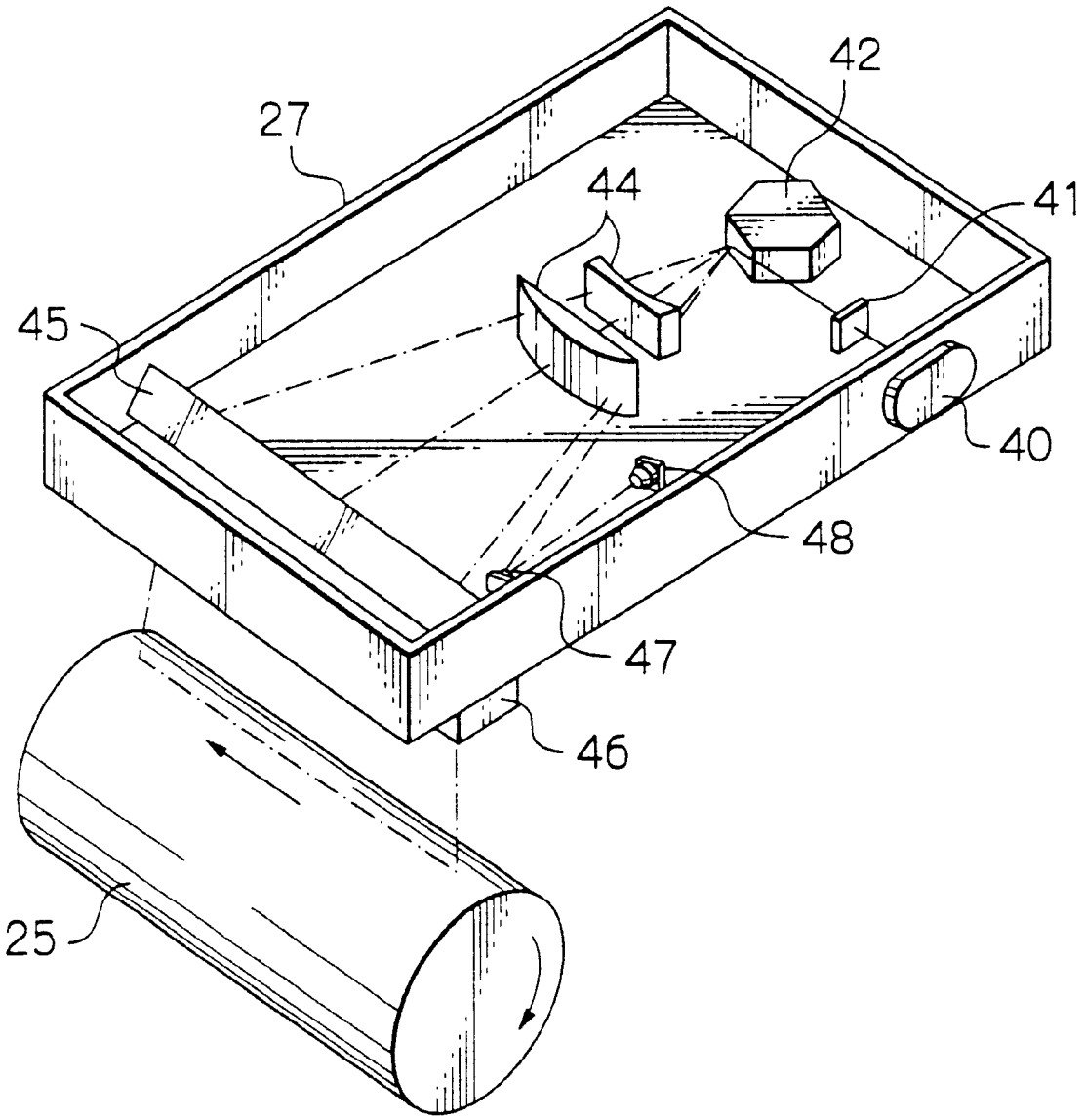
FIG. 6 is a perspective view showing the laser beam scanning unit of FIG. 5 more specifically.

Referring to FIGS. 4 through 6, an image forming apparatus embodying the present invention is shown and implemented as a digital copier by way of example. In FIGS. 4 through 6, structural elements identical with the structural elements shown in FIG. 1 are designated by identical reference numerals, and a detailed description thereof will not be made in order to avoid redundancy. As shown in FIG. 4, the digital copier includes an image reading device 11, a printer section 12 including a laser beam scanning device 27, and an ADF (Automatic Document Feeder) 13.

As shown in FIGS. 4 and 5, the document reading device 11 includes a first carriage A and a second carriage B. The first carriage A is loaded with a lamp or light source 15, a reflector 16, and a first mirror 17 while the second carriage B is loaded with a second mirror 18 and a third mirror 19. To read a document laid on a glass platen 14, the first carriage A moves from a home position indicated by a solid line to the right end (position A') of the device 11 at a preselected speed. The second carriage B moves to substantially the center (position B') of the device 11 at a speed that is one-half of the speed of the first carriage A. The lamp 15 of the first carriage A optically scans the document while the carriage A is in movement.

More specifically, light issuing from the lamp 15 illuminates the document on the glass platen 14 via the reflector 16. The resulting reflection from the document is sequentially reflected by the first to third mirrors 17 through 19 and then incident to a CCD (Charge Coupled Device) image sensor 22 via a color filter 20 and a lens 21. The CCD image sensor 22 transforms the incident light representative of the document to an analog image signal. After the document reading device 11 has read the document in the above-described manner, the carriages A and B are returned to their home positions indicated by solid lines. The CCD image sensor 22 may be implemented by a three-line image sensor having a red (R), a green (G) and a blue (B) filter on a respective line, so that the image reading device 11 can read a color document.

An analog-to-digital converter, not shown, converts the analog image signal output from the image sensor 22 to a digital image signal. An image processing board 23 executes various kinds of conventional image processing (bilevel or multilevel conversion, tonality processing, magnification change, editing, etc.) with the digital image signal.

The printer section 12 includes an image carrier 25 implemented as a photoconductive drum by way of example. A charger 26 uniformly charges the surface of the image carrier 25. A developing unit 28 develops a latent image formed on the image carrier. An image transferring device 30 transfers a toner image formed on the image carrier 25 to a paper sheet or similar recording medium. A separating device 31 separates the paper sheet from the image carrier 25. Paper trays 33 through 35 each are loaded with a stack of paper sheets. A registration roller pair 36 drives the paper sheet fed from any one of the paper trays 33 through 35 toward an image transfer position at a preselected timing. A conveyor 37 conveys the paper sheet carrying a toner image thereon to a fixing unit 38, which will be described later. The fixing unit 38 fixes the toner image on the paper sheet. The paper sheet coming out of the fixing unit 38 is driven out to a tray 39.

As shown in FIGS. 4 and 6, the laser beam scanning device 27 includes a semiconductor laser unit 40 for emitting a laser beam modulated on the basis of a write clock. A cylindrical lens 41 causes the laser beam to converge in the subscanning direction. A polygonal mirror 42 reflects the laser beam incident thereto via the cylindrical lens 41 with reflection faces thereof. At the same time, the polygonal mirror 42 is caused to rotate by a polygon motor 43 in order to steer the laser beam, thereby scanning the image carrier 25. An f-θ lens 44 provides the laser beam reflected from the polygonal mirror 42 and having a constant angular velocity with a constant scanning speed, as measured on the image carrier 25. A mirror 45 reflects the laser beam output from the f-θ lens 44 toward the image carrier 25. A dust glass 46 prevents dust from entering the semiconductor laser unit 40 while transmitting the laser beam. A mirror 47 and a sensor 48 cooperate to sense the synchronization of the laser beam.

More specifically, the laser beam issuing from the semiconductor laser is transformed to a parallel beam by a collimator lens, not shown, and then passed through an aperture, not shown, to have a preselected shape. The polygonal mirror has an accurate polygonal configuration and is driven by the polygon motor 43 at a constant speed in a preselected direction. The rotation speed of the polygonal mirror 42 is determined by the rotation speed of the image carrier 25, the writing density of the laser beam scanning device 27, and the number of faces of the polygonal mirror 42. The f-θ lens 44 has a function of compensating for the inaccuracy of configuration of the polygonal mirror 42 in addition to the previously stated function. The mirror 47 is positioned outside of an image range for reflecting the laser beam output from the f-θ lens 44 toward the sensor 48. The resulting output of the sensor 48 is used to generate a synchronizing signal that defines a write start position in the main scanning direction.

As shown in FIG. 4, a write clock controller 51 feeds a clock that provides reference pulses for the laser beam to issue from the semiconductor laser unit 40. A scanning speed controller 52 controls the polygon motor 43 in order to control the speed at which the laser beam scans the image carrier 25. A conveyance controller 53 controls a paper conveying speed by controlling the speed of the registration roller pair 36 and that of the conveyor 37. An image carrier controller 54 controls the rotation speed or linear velocity of the image carrier 25. A main controller 50 controls the entire image forming apparatus as well as the above controllers 51 through 54. A manual speed setting 55 allows the operator of the apparatus to input a desired paper conveying speed, which is controlled by the conveyance controller 53.

The ADF 13 sequentially conveys documents stacked on, e.g., a tray to the glass platen 14 one by one. After the document set on the glass platen 14 has been copied, the ADF 13 discharges the document.

In operation, a driveline, not shown, causes the image carrier 25 to rotate under the control of the main controller 50 and image carrier controller 54. The charger 26 uniformly charges the surface of the image carrier 25. A digital image signal output from the image reading device 11 and then processed by the image processing board 23 is sent the semiconductor laser unit 40 via a semiconductor drive board not shown. The laser beam scanning device 27 exposes the charged surface of the image carrier 25 imagewise with the laser beam, which issues from the laser unit 40 under the control of the write clock controller 51. As a result, a latent image is electrostatically formed on the image carrier 25. The developing unit 28 develops the latent image with toner to thereby form a toner image on the image carrier 25.

A paper sheet is fed from any one of the paper trays 33 through 35 to the registration roller pair 36. The registration roller pair 36 once stops the paper sheet and then drives it at such a timing that the leading edge of the paper sheets meets the leading edge of the toner image formed on the image carrier 25 at an image transfer position 8. The image transferring device 30 located at the image transfer position 8 transfers the toner image from the image carrier 25 to the paper sheet. The separating device 31 separates the paper sheet from the image carrier 25. The conveyor 37 conveys the paper sheet separated from the image carrier 25 to the fixing unit 38. After the fixing unit 38 has fixed the toner image on the paper sheet, the paper sheet or copy is driven out to the tray 39. After the paper sheet has been separated from the image carrier 25, a cleaning unit 32 removes the toner left on the image carrier 25.

Operations unique to the illustrative embodiment will be described hereinafter.

In the illustrative embodiment, the main controller 50, conveyance controller 53 and image carrier controller 54 are constructed to make the mean linear velocity of the paper sheet higher than the mean linear velocity of the image carrier 25 during image transfer. It follows that while the image carrier 25 is in contact with the paper sheet, the former is constantly drawn by the latter in the direction of rotation, i.e., the forward direction. This is successful to obviate backlash occurring when the image carrier 25 is in contact with the paper sheet. The rotation of the image carrier 25 is therefore free from instability ascribable to the backlash, insuring stable image formation on the image carrier 25.

Figure 7:
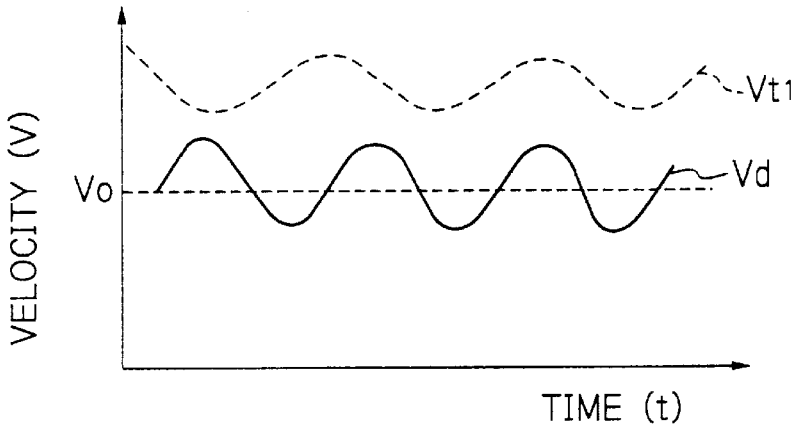
FIG. 7 is a graph showing how the linear velocity of a paper sheet and that of an image carrier included in the illustrative embodiment vary when the mean value of the former is higher than the mean value of the latter.
Figure 8:
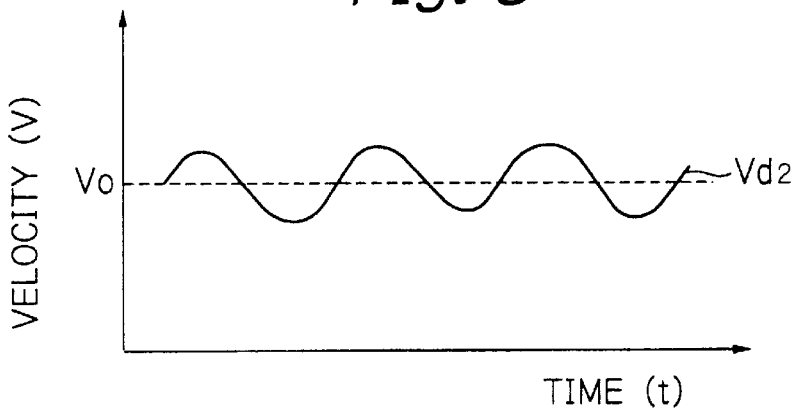
FIG. 8 is a graph showing that the illustrative embodiment obviates backlash on the image carrier ascribable to the linear velocity of the paper sheet.

FIG. 7 shows variations derived from the mean linear velocity Vt of the paper sheet higher than the mean linear velocity Vd of the image carrier 25. FIG. 8 shows the fact that the backlash ascribable to a difference in linear velocity between the image carrier 25 and the paper sheet is obviated. As shown in FIG. 7, when the linear velocity Vt1 of the paper sheet is higher than the linear velocity of the image carrier 25, the image carrier 25 rotates while being constantly drawn by the paper sheet in the direction of rotation due to the backlash. As a result, as shown in FIG. 8, the linear velocity, labeled Vd2, of the image carrier 25 smoothly varies in contrast to the linear velocity Vd1 of the conventional image carrier 25.

When the linear velocity Vd of the image carrier 25 and the linear velocity Vt1 of the paper sheet differ from each other, as in the illustrative embodiment, the image carrier 25 rubs the toner image transferred to the paper sheet at the image transfer position, as stated earlier. Therefore, the difference between the linear velocities Vd and Vt1 should not be excessively great. Further, if the paper sheet moves at a 0.2% higher speed than the image carrier 25 in terms of linear velocity, a toner image transferred to the paper sheet is enlarged by 0.2% in the subscanning direction, compared to the toner image on the image carrier 25. In this respect, too, the above difference should not be excessively great; an image with a minimum of magnification error is one of keen demands on the market. On the other hand, because the driving force of the driveline assigned to the image carrier 25 and that of the driveline assigned to the paper conveying system fluctuate, an excessively small difference would be cancelled by the fluctuation and would therefore be meaningless.

In light of the above, the main controller 50, conveyance controller 53 and image carrier controller 54 cause the linear velocity Vt1 of the paper sheet to vary within the range of from 0.1% to 3% of the linear velocity Vd of the image carrier 25. A difference lying in such a range is greater than the fluctuation of the above-mentioned driving forces, but causes the image carrier 25 to rub the toner image of the paper sheet little. In addition, the magnification error of the toner image transferred to the paper sheet is reduced in the subscanning direction.

In the illustrative embodiment, some magnification error occurs in a toner image in the subscanning direction. To correct such a magnification error, the main controller 50 and scanning speed controller 52 control the deflection speed of the polygonal mirror or deflector 42. For example, when a toner image transferred to a paper sheet is enlarged, the main controller 50 and scanning speed controller 52 cause a latent image to be reduced in the subscanning direction on the image carrier 25 beforehand. This successfully provides the toner image transferred to a paper sheet with an accurate magnification. Specifically, in the illustrative embodiment, the polygonal motor 43 is caused to rotate at a speed higher than a speed theoretically calculated from the linear velocity Vd of the image carrier 25 and the writing density. More specifically, to make the linear velocity Vt1 of a paper sheet higher than the linear velocity Vd of the image carrier 25, the main controller 50 and scanning speed controller 52 correct the speed of the polygon motor 43 such that it is higher than the theoretical speed by the ratio. Conversely, to make the linear velocity Vt1 of a paper sheet lower than the linear velocity Vd of the image carrier 25, the main controller 50 and scanning speed controller 52 correct the speed of the polygon motor 43 such that it is lower than the theoretical speed by the ratio. In this manner, the illustrative embodiment accurately corrects the magnification error of a toner image to be transferred to a paper sheet in the subscanning direction.

The above correction of the speed of the polygon motor 43, however, brings about a problem as to a magnification in the main scanning direction. Specifically, an image is enlarged in the main scanning direction when the rotation of the polygon motor 43 is accelerated or is reduced in the same direction when it is decelerated. In the illustrative embodiment, the main controller 50 and write clock controller 51 correct the write clock in such a manner as to obviate the enlargement and reduction in the main scanning direction for thereby enhancing an accurate magnification in the same direction. For example, when the speed of the polygon motor 43 is made higher than the theoretical speed, the main controller 50 and write clock controller 51 increase the rate of the write clock accordingly to thereby prevent an image from being enlarged in the main scanning direction. In this manner, the illustrative embodiment is capable of correcting a magnification error in both of the subscanning and main scanning directions, insuring an image having a highly accurate magnification.

The magnification of an image fixed on a paper sheet and actually output from the image forming apparatus sometimes differs from a desired magnification due to, e.g., the kind of the paper sheet and the condition (amount of moisture) of the paper sheet before fixation. For example, even if a latent image or a toner image is formed on the image carrier 25 with an accurate magnification, the toner image transferred to or fixed on a paper sheet may have been varied because of the above factors. On the other hand, in the illustrative embodiment, the main controller, conveyance controller 53 and image carrier controller 54 can vary the linear velocity of the paper sheet relative to the linear velocity of the image carrier 25 and therefore the magnification of an image in the subscanning direction at the image transfer position 8. For example, when a paper sheet is so controlled as to move at a 1% higher linear velocity than the image carrier 25, a toner image is transferred from the image carrier 25 to the paper sheet while being enlarged by 1%.

In the illustrative embodiment, the manual speed setting 55 and main controller 50 allow the operator to set a desired paper conveying speed, i.e., to adjust the magnification of a toner image to be finally formed on a paper sheet in the subscanning direction. This is successful to correct the magnification error of a toner image ascribable to, e.g., the kind of a paper sheet and the condition of the paper sheet before fixation.

The above-described operations unique to the illustrative embodiment are applicable even to an image forming apparatus of the type transferring a toner image from the image carrier 25 to a paper sheet by way of an intermediate image transfer body.

Figure 9:
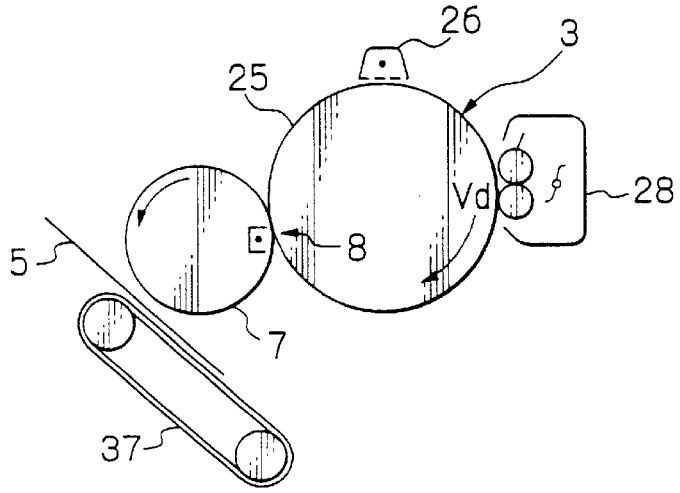
FIG. 9 is a fragmentary view showing an alternative embodiment of the present invention.

Reference will be made to FIG. 9 for describing an alternative embodiment of the present invention including the above-mentioned intermediate image transfer body. As shown, an image forming apparatus includes an intermediate image transfer body 7 implemented as a belt. Atoner image formed on the image carrier 25 is transferred to the intermediate image transfer body 7. Subsequently, the toner image is transferred from the intermediate image transfer body 7 to a paper sheet 5. This embodiment includes an intermediate image transfer body controller, not shown, for controlling the linear velocity of the intermediate image transfer body 7. The main controller 50 controls this controller as well as the conveyance controller 53 or the image carrier controller 54. In the illustrative embodiment, the main controller 50 controls the intermediate image transfer body controller and conveyance controller 53 such that the mean linear velocity of the body 7, which is a substitute for the mean linear velocity of the image carrier controller 25, and the mean linear velocity of the paper sheet 5 differ from each other. Generally, a color image forming apparatus often includes the intermediate image transfer body 7.

In the illustrative embodiment, when the linear velocity of the paper sheet 5 varies, it causes the linear velocity of the intermediate image transfer body 7 contacting the paper sheet 5 to vary. As a result, the linear velocity of the image carrier 25 contacting the intermediate image transfer body 7 varies. The linear velocity of the paper sheet 5 therefore effects a toner image to be transferred from the image carrier to the intermediate transfer body 7 at the image transfer section 8, and in addition effects the linear velocity Vd of the image carrier 25. In the illustrative embodiment, the above-described control scheme obviates the variation of the intermediate image transfer body 7, which contacts the paper sheet 5, and therefore the variation of the image carrier 25. The image carrier 25 can therefore rotate stably and insures stable image formation.

In summary, it will be seen that the present invention provides an image forming apparatus having various unprecedented advantages, as enumerated below.

(1) Backlash ascribable to the contact of an image carrier with a paper sheet does not occur. The image carrier is therefore free from unstable rotation, insuring stable image formation.

(2) The image carrier does not rub a toner image transferred to a paper sheet at an image transfer position. The magnification error of a toner image to be transferred to a paper sheet is reduced in the subscanning direction. The magnification error is reduced in the main scanning direction as well. It is therefore possible to produce a copy with an accurate magnification.

(3) The magnification error of a toner image can be corrected in accordance with the kind of a paper sheet and the condition (amount of moisture) of the paper sheet before fixation.

(4) Even in an image forming apparatus of the type including an intermediate image transfer body, the image carrier is free from unstable rotation and insures stable image formation.

Various modifications will become possible for those skilled in the art after receiving the teachings of the present disclosure without departing from the scope thereof.

What is claimed is:

1. An image forming apparatus comprising:

an image carrier configured to carry a toner image thereon while being driven to rotate;

a conveyor constructed to convey a recording medium, to which the toner image is to be transferred from said image carrier, to an image transfer position;

an image carrier controller constructed to control a linear velocity of said image carrier in rotation;

a conveyance controller constructed to control a linear velocity of the recording medium being conveyed by said conveyor;

a main controller constructed to control said image carrier controller and said conveyance controller such that a mean linear velocity of said image carrier is maintained at 0.1% to 3% higher than a mean linear velocity of said image carrier; and a manual speed setting device constructed to allow an operator of said apparatus to set a desired mean linear velocity of the recording medium relative to the mean linear velocity of said image carrier.

2. An apparatus as claimed in claim 1, further comprising:

an intermediate image transfer body via which the toner image is transferred from said image carrier to the recording medium; and an intermediate image transfer body controller constructed to control a linear velocity of said intermediate image transfer body under a control of said main controller;

wherein said main controller controls said intermediate image transfer body controller and said conveyance controller such that a mean linear velocity of said intermediate image transfer body and the mean linear velocity of the recording medium are different from each other.

3. An image forming apparatus comprising:

an image carrier for carrying a toner image thereon while being driven to rotate;

conveying means for conveying a recording medium, to which the toner image is to be transferred from said image carrier, to an image transfer position;

image carrier control means for controlling a linear velocity of said image carrier in rotation;

conveyance control means for controlling a linear velocity of the recording medium being conveyed by, said conveying means;

main control means for controlling said image carrier control means and said conveyance control means such that a mean linear velocity of said image carrier is maintained at 0.1% to 3% higher than a mean linear velocity of said image carrier; and manual speed setting means for allowing an operator of said apparatus to set a desired mean linear velocity of the recording medium relative to the mean linear velocity of said image carrier.

4. An apparatus as claimed in claim 3, further comprising:

an intermediate image transfer body via which the toner image is transferred from said image carrier to the recording medium; and intermediate image transfer body control means for controlling a linear velocity of said intermediate image transfer body under a control of said main control means;

wherein said main control means controls said intermediate image transfer body control means and said conveyance control means such that a mean linear velocity of said intermediate image transfer body and the mean linear velocity of the recording medium are different from each other.

* * * * *